US008381318B2

(12) United States Patent
Junker et al.

(10) Patent No.: US 8,381,318 B2
(45) Date of Patent: Feb. 26, 2013

(54) ADAPTER FOR PROTECTIVE HELMETS

(75) Inventors: Ulf Junker, Hanau (DE); Stefan Roemer, Gundelfingen (DE)

(73) Assignee: E.D. Bullard Company, Cynthiana, KY (US)

( * ) Notice: Subject to any disclaimer, the term of this patent is extended or adjusted under 35 U.S.C. 154(b) by 386 days.

(21) Appl. No.: 12/820,520

(22) Filed: Jun. 22, 2010

(65) Prior Publication Data

US 2011/0252546 A1 Oct. 20, 2011

(30) Foreign Application Priority Data

Apr. 19, 2010 (DE) ..... 10 2010 015 581

(51) Int. Cl.
*A42B 3/04* (2006.01)

(52) U.S. Cl. ..... 2/422

(58) Field of Classification Search ..... 2/422, 6.2, 2/209.13, 336, 338; 24/3.1, 305, 457, 458, 24/481, 485, 594.11; 362/105, 106, 107, 362/108, 191; 224/181; 248/226.11, 205.1, 248/220.21, 222.11

See application file for complete search history.

(56) References Cited

U.S. PATENT DOCUMENTS

| | | | | |
|---|---|---|---|---|
| 3,491,372 | A * | 1/1970 | Aileo | 2/9 |
| 4,124,902 | A | 11/1978 | Seres et al. | |
| 4,521,831 | A | 6/1985 | Thayer | |
| 4,907,582 | A * | 3/1990 | Meyerrose | 128/201.11 |
| 5,438,494 | A * | 8/1995 | Harlan | 362/106 |
| 5,460,346 | A * | 10/1995 | Hirsch | 248/229.13 |
| 5,608,919 | A | 3/1997 | Case | |
| 5,658,065 | A * | 8/1997 | Jamieson | 362/106 |

(Continued)

FOREIGN PATENT DOCUMENTS

| | | | |
|---|---|---|---|
| DE | 29922890 | U1 | 4/2000 |
| DE | 202005006121 | U1 | 6/2005 |

(Continued)

OTHER PUBLICATIONS

EPO, Extended European Search report for corresponding European Patent Application No. 11003186.1, dated Mar. 23, 2012.

(Continued)

*Primary Examiner* — Amy Vanatta

(74) *Attorney, Agent, or Firm* — Stites & Harbison, PLLC; David W. Nagle, Jr.

(57) ABSTRACT

An adapter for mounting equipment (4) such as lamps and headsets onto protective helmets includes a base (1) fastened detachably onto the protective helmet, and a holder (2) with variable securing parts (3) that snaps detachably into the base (1). The base (1) features a snap-and-detent mechanism (1.1), has an external shape adapted to the type of protective helmet and is fastened detachably onto the protective helmet. The holder (2) features a snap-and-detent element (2.5) designed as corresponding counter piece to the snap-and-detent mechanism (1.1) of the base (1). The variable securing parts (3) are flat silicone straps where at least two securing parts (3) can be threaded into the holder (2), an insertable piece of equipment (4) can be fastened separately, flexibly and detachably by wrapping the two securing parts (3) around the equipment (4) and anchoring them onto the holder (2), and the snap-and-detent element (2.5) of the equipped holder (2) snaps into the snap-and-detent mechanism (1.1) of the base (1) and, when in the base (1), is incrementally rotatable and detainable around the axis of the snap-and-detent element (2.5).

7 Claims, 6 Drawing Sheets

U.S. PATENT DOCUMENTS

| | | | | |
|---|---|---|---|---|
| 6,616,294 | B1 * | 9/2003 | Henry | 362/106 |
| 7,636,954 | B2 | 12/2009 | Lang-Ree et al. | |
| 8,245,320 | B2 * | 8/2012 | Provost et al. | 2/13 |
| 2006/0080761 | A1 | 4/2006 | Huh | |
| 2007/0103891 | A1 | 5/2007 | Schot | |
| 2009/0077721 | A1 * | 3/2009 | Prendergast | 2/422 |
| 2009/0144872 | A1 * | 6/2009 | Lebel et al. | 2/6.7 |
| 2010/0012692 | A1 * | 1/2010 | Harris et al. | 224/181 |
| 2010/0180364 | A1 * | 7/2010 | Willey et al. | 2/422 |
| 2010/0325784 | A1 | 12/2010 | Abbott et al. | |
| 2011/0072562 | A1 * | 3/2011 | Prendergast | 2/422 |

FOREIGN PATENT DOCUMENTS

| | | | |
|---|---|---|---|
| DE | 202005004936 | U1 | 7/2005 |
| DE | 602004007383 | T2 | 3/2008 |
| EP | 0751720 | B1 | 5/2000 |
| WO | 2006112735 | A1 | 10/2006 |

OTHER PUBLICATIONS

German Patent and Trademark Office, Search report for corresponding German Patent Application No. 10 2010 0150 581.0, completed Mar. 21, 2011.

* cited by examiner

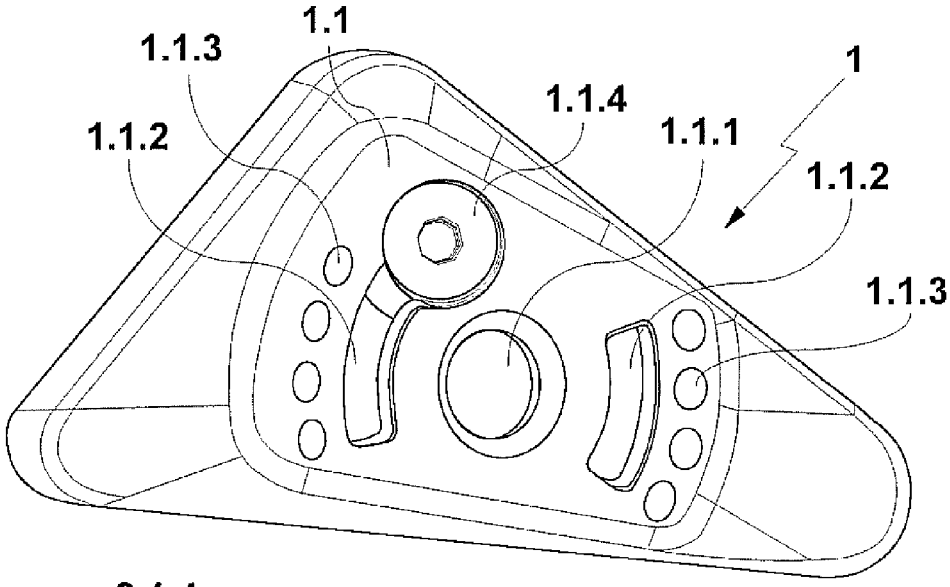
Fig. 1
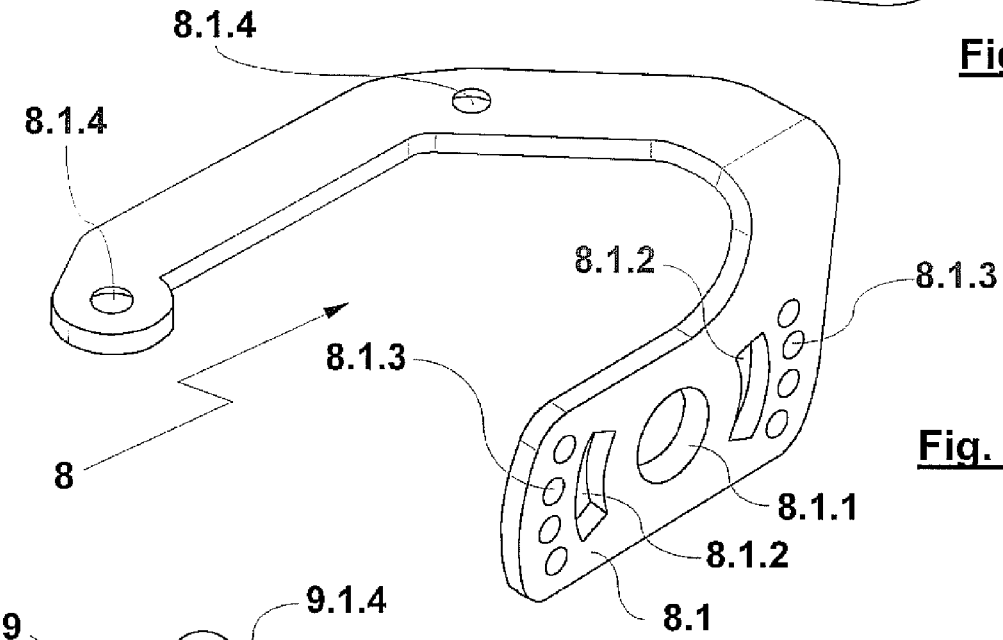
Fig. 1.1
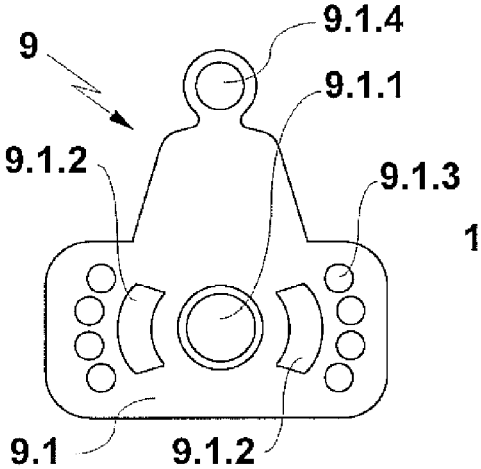
Fig. 1.2
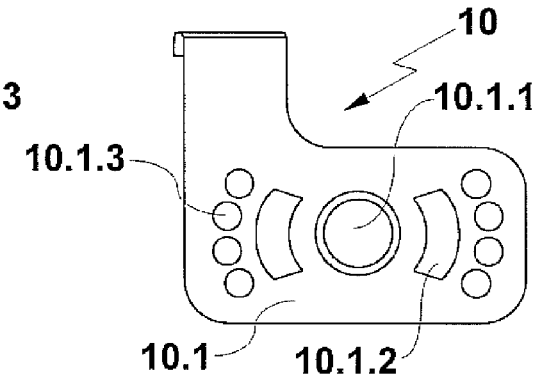
Fig. 1.3

ADAPTER FOR PROTECTIVE HELMETS

CROSS-REFERENCE TO RELATED APPLICATIONS

The present application claims priority to German Patent Application No. 10 2010 015 581.0 filed on Apr. 19, 2010.

TECHNICAL FIELD

The invention concerns an adapter for protective helmets that accommodates equipment such as lamps and headsets used in the field of technical and medical emergency services, fire fighting, interior structural fire fighting, forest fire fighting and mountain, water and high-altitude rescue services.

BACKGROUND OF THE INVENTION

EP 0 751 720 B 1 describes a flashlight holder for protective helmets comprising a carrier element, an adjustment means, and a mounting adaptor means connected to the carrier element by said adjustment means, characterized in that the mounting adaptor means is adapted to releasably attach the holder directly to a side of the protective helmet, to withstand extensive abuse in a heavy industrial environment, and that the adjustment means allows for rotation of the carrier element in any direction relative to the mounting adaptor means, where the adjustment means comprises a swivel ball-socket arrangement, where the ball of this ball-socket arrangement is an integral part of the carrier element, where the socket of the ball-socket arrangement is incorporated within an upper part of the mounting adaptor means, and where the ball of the ball-socket arrangement is secured into the socket by tightening means. This holder consists of many individual parts, including a ball-socket arrangement that must be elaborately mounted onto the brim of a helmet. One particular disadvantage of this solution is that, while the lamp is arranged on the side of the helmet, it rests far above the wearer's eye level, which severely impairs the visibility for the helmet wearer especially when fighting smoky fires.

An adapter for fastening accessories, in particular headsets, onto protective helmets is known from DE 20 2005 004 936 U1. This solution involves two adapter parts that slide into one another with the help of rails and grooves, where one adapter part is fastened onto the helmet and the second adapter part serves to accommodate the headset. It also features a ratchet element that locks the adapter parts against slipping when slid into one another. The disadvantage of this solution is the necessity for many threaded connections on the helmet and on the equipment. Furthermore, the adapter parts can become jammed when sliding them together, which is time consuming and problematic especially when the equipment needs to be deployed rapidly.

Another adapter for a protective helmet is known from DE 20 2005 006 121 U1. The purpose of this invention is to produce an adapter that can be fitted onto a protective helmet with a thick and/or contoured brim, to allow attachment of accessories such as headsets or flashlights onto the protective helmet. The problem is solved with an adaptor comprising two parts that push into one another, where one part is clipped onto the underside of a helmet brim of said shape, and the second adapter part pushes in parallel to the brim of the helmet. The push-in adapter part has a hole for screwing a headset onto it, for example. It is neither described nor discernible from the drawings as to how, for example, a lamp can be quickly fastened to this adapter. Furthermore, the lamp would rest unfavorably below or above the eye level of the helmet wearer.

The problem was therefore to invent a retrofittable adapter for protective helmets for rapid, separate or combined mounting and removal of equipment such as flashlights and headsets that allows lamps to be mounted at the essential eye level and headsets to be mounted in the ear and mouth area, and which is quick and easy to manipulate and can be deployed on different types of protective helmets.

SUMMARY OF THE INVENTION

This problem is solved by an adaptor for protective helmets that generally comprises a base that has a snap-and-detent mechanism and an external shape adapted to the type of protective helmet, and which is fastened detachably to the protective helmet. The advantage of this is that the base can always be equipped with the same snap-and-detent mechanism irrespective of its overall shape, which is adapted to the protective helmet.

The advantage of this fundamental design of the base is further enhanced by a separate holder according to the invention that has a snap-and-detent element, which is executed as the corresponding counter piece to the snap-and-detent mechanism of the base.

Also advantageous are the securing parts, which are executed as flat silicone straps. These are sturdy and heat-resistant, practically non-wearing and can be easily adjusted to the size and shape of equipment, such as different lamps, for example.

It is especially advantageous for at least two securing parts to be insertable into the separate holder. A piece of equipment such as a lamp can be inserted onto the concave holder elements that rest firmly in the concave holder. Equipment of different shapes and sizes can be separately, flexibly, stably and detachably fastened into the holder by wrapping the two securing parts over the lamp and anchoring said securing parts onto the holder. The helmet wearer can snap the separately equipped holder into the snap-and-detent mechanism of the base by its snap-and-detent element, and rotate and incrementally detain it around the axis of the snap-and-detent element in the base. The separate holder, with its securing parts and secured equipment, can also be removed again from of the snap-and-detent mechanism of the base and, if necessary, replaced by another holder bearing a different piece of equipment.

The snap-and-detent mechanism of the base may also feature a central, round hole with two guide openings arranged around the hole and several round indentations arranged around the guide openings, where the guide openings of the base are shaped as arcs of a circle positioned diametrically opposite each other in axial direction at a defined distance from the central, round hole, and where the round indentations are arranged into arcs of a circle and positioned diametrically opposite each other in axial direction at a defined distance from the guide openings. Every base features this fundamental design, irrespective of its overall structural shape. This has the advantage that the base can have a different external shape while featuring the exact same snap-and-detent mechanism and at least one opening for detachably fastening it to the respective protective helmet.

Also to be emphasized is the holder, which is essentially a rectangular part with two outer longitudinal sections molded at a defined angle to a central longitudinal section to form an overall concave shape, where a fastening lug is molded onto each end of the outer edge of one longitudinal section, and a keyhole-shaped opening is molded into each end of the central longitudinal section, at the centre of which the snap-and-detent element is molded into the outer surface. When the securing straps are inserted into the keyhole-shaped openings in the central longitudinal section, the concave holder elements molded onto the face side of the silicone straps rest against the concave, inner surface of the holder. When inserting a piece of equipment, the silicone straps are wrapped around the outside of the holder and the piece of equipment, and the slot hole of each strap pushed over one of the fastening lugs molded onto the outer edge of the holder, thus retaining the straps. This has the advantage that the piece of equipment can be separately secured into the holder, and the ensemble then snapped into and back out of the base that is fastened onto the protective helmet.

The quick and easy snapping in and out of the holder bearing the respective piece of equipment is ensured by the design of the snap-and-detent element, wherein a snap-and-detent element is molded radially to the central longitudinal section between the keyhole-shaped openings and features a central snap piece consisting of several circular, relatively moveable snap-lugs, with two relatively moveable guide pins molded diametrically opposite each other in axial direction and two spherical bumps molded diametrically opposite each other in axial direction, and with two parabolic openings molded diametrically opposite each other in axial direction. The parabolic openings consequently form parabolic tabs, onto each of which a guide pin and a spherical bump are molded diametrically opposite one another in axial direction, which can move relative to the central snap piece. As the central snap piece snaps into the central hole of the base, and as the guide pins are movably inserted into the guide openings of the spherical bumps, the spherical bumps firmly fasten into two respective, diametrically opposite round indentations, thereby detaining the holder bearing the equipment at a desired adjustment angle of the equipment.

While the relatively moveable snap-lugs on the central snap piece advantageously support their snapping into the central hole of the base, the parabolic tabs with guide pin and spherical bump support a firmly executed rotation of the holder bearing the piece of equipment in the guide openings of the base, and the spherical bumps support their incremental detention in two respective round indentations in the base.

The structural design of the base and holder and of the flexible securing elements and their corresponding parts allows flexible adaptation to different equipment, high stability and longevity of the securing elements, and their quick and easy use.

Additional mounting and connecting elements of various shape and design allows the accommodation of additional equipment, such as headsets and their separate or coupled arrangement with lamps on the protective helmet. The mounting and connecting elements are designed such that they can be arranged on one side of a protective helmet either separately or in combination by coupling the adapter with the base, the holder and securing parts for simultaneous arrangement of two pieces of equipment such as a lamp and a headset.

Finally, it must be emphasized in particular that the adapter can be used on different types of protective helmet, in that the external shape of further bases can be adapted to different types of protective helmet while all bases are equipped with a snap-and-detent mechanism that corresponds with the snap-and-detent element of the holder.

DESCRIPTION OF THE DRAWINGS

The invention is described in further detail below with the help of an illustrative embodiment. The drawings illustrate:

FIG. 1 Front view of a first adapter base,

FIG. 1.1 Perspective view of a second base,

FIG. 1.2 Front view of a third base,

FIG. 1.3 Front view of a fourth base,

DETAILED DESCRIPTION OF THE INVENTION

Figure 2:
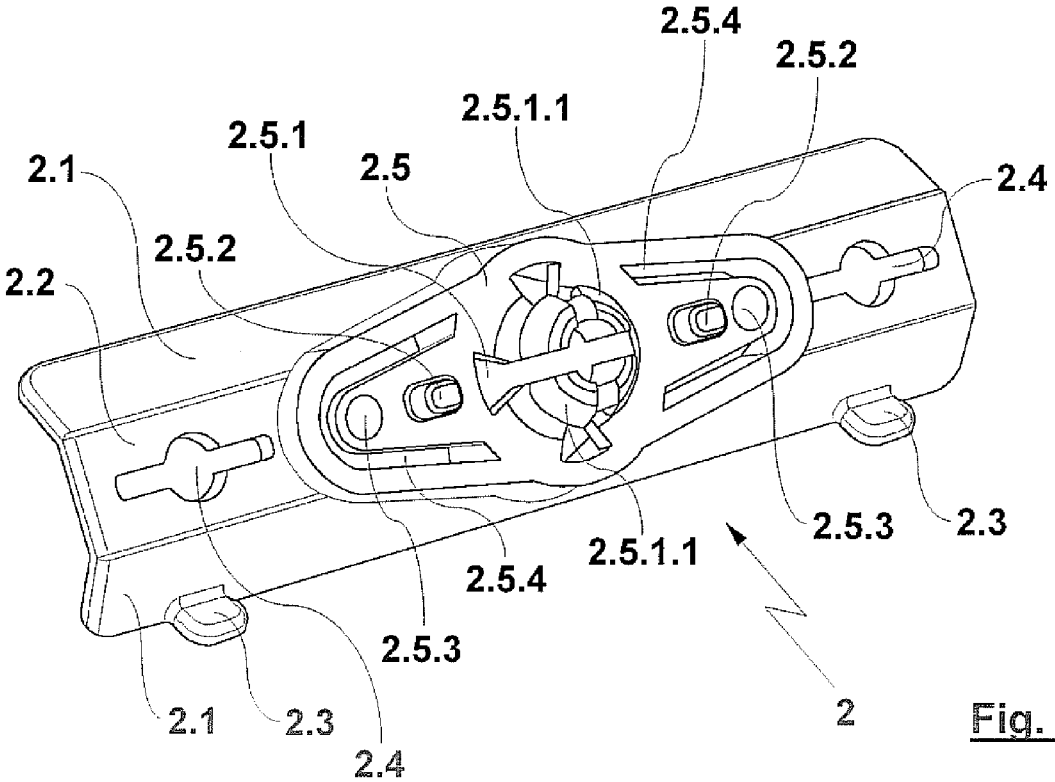
FIG. 2 Perspective rear view of an adapter holder.
Figure 3:
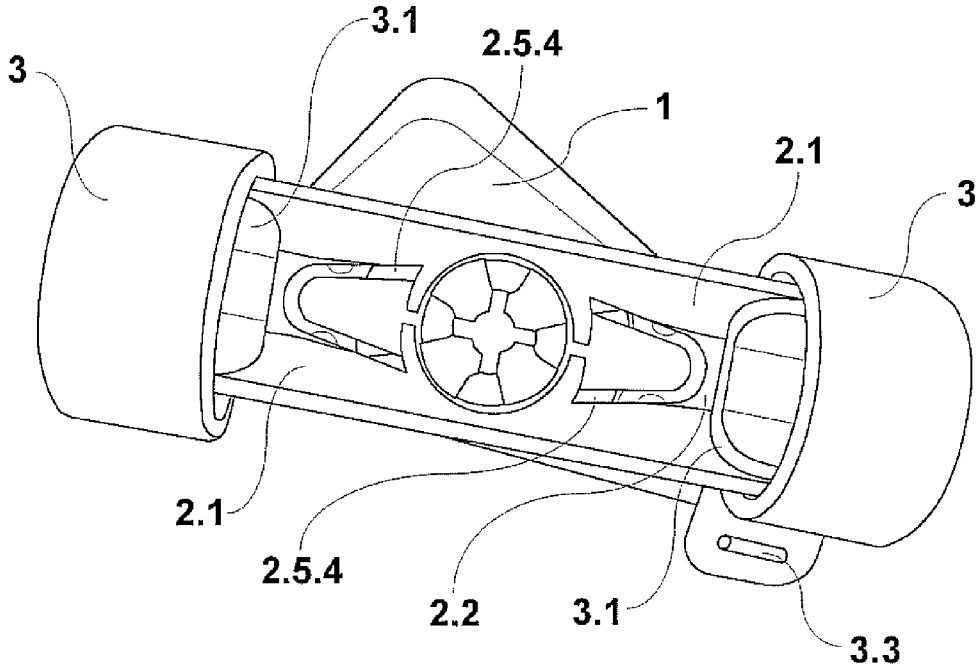
FIG. 3 Front view of a holder with securing elements, clicked into a base according to FIG. 1, FIG. 4 Front view of a securing element, FIG. 5 Top view of FIG. 4, FIG. 6 Side view of FIG. 3, FIG. 7 Rear view of a base according to FIG. 1 with holder, bearing securing elements and equipment, snapped on, FIG. 8 A complete adapter bearing equipment mounted onto the section of a protective helmet, FIG. 9 Perspective view of a first mounting and connecting part for a headset, FIG. 10 Perspective view of a second mounting and connecting part for combination and coupling with the adapter according to FIG. 14, FIG. 11 Perspective view of a third mounting and connecting part for separate arrangement of a headset onto a protective helmet according to FIG. 12, FIG. 12 Perspective view of a protective helmet with adapter and base, according to FIG. 1.2, on one side of the helmet and mounting and connecting parts FIG. 9 and FIG. 11 on the other side, FIG. 13 Front view of a protective helmet with mounting part according to FIG. 9 for headset on one side and adapter with base according to FIG. 1.1 on the other side, FIG. 14 Side view of a protective helmet with adapter and lamp with base, according to FIG. 1.3, combined with headset, fastened onto the helmet, and FIG. 15 Perspective view of FIG. 14.
Figure 4:
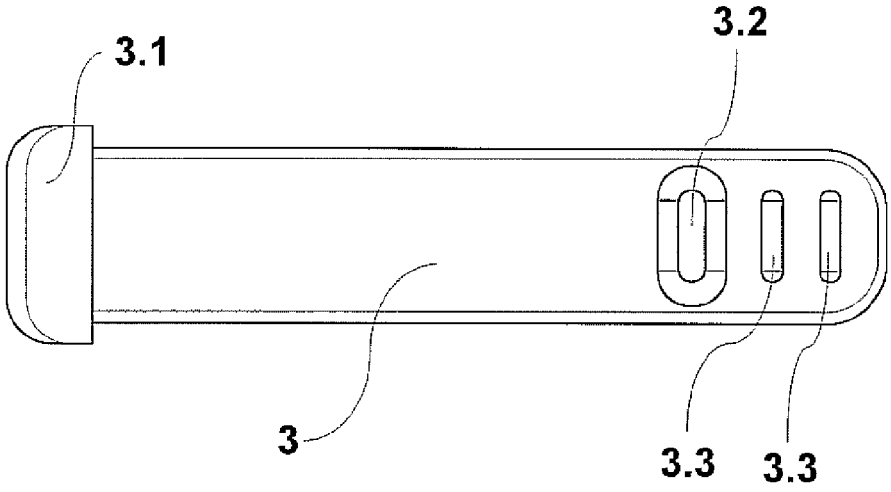
Figure 5:
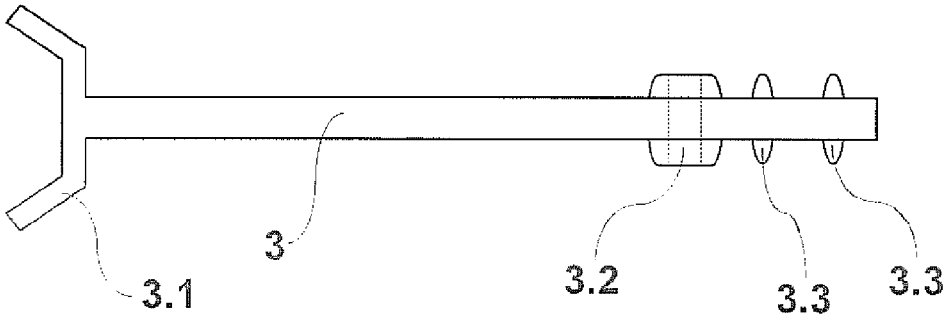
Figure 6:
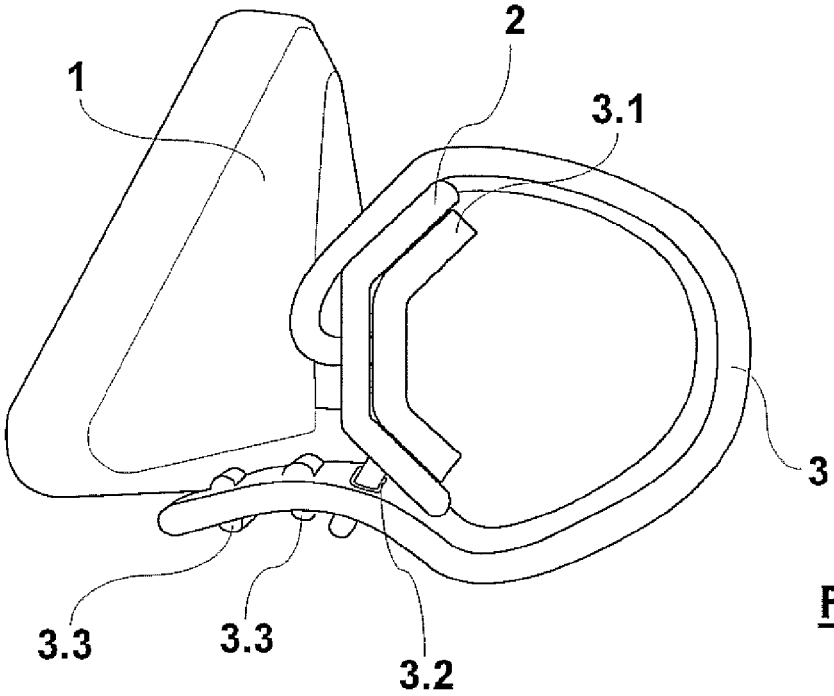
Figure 7:
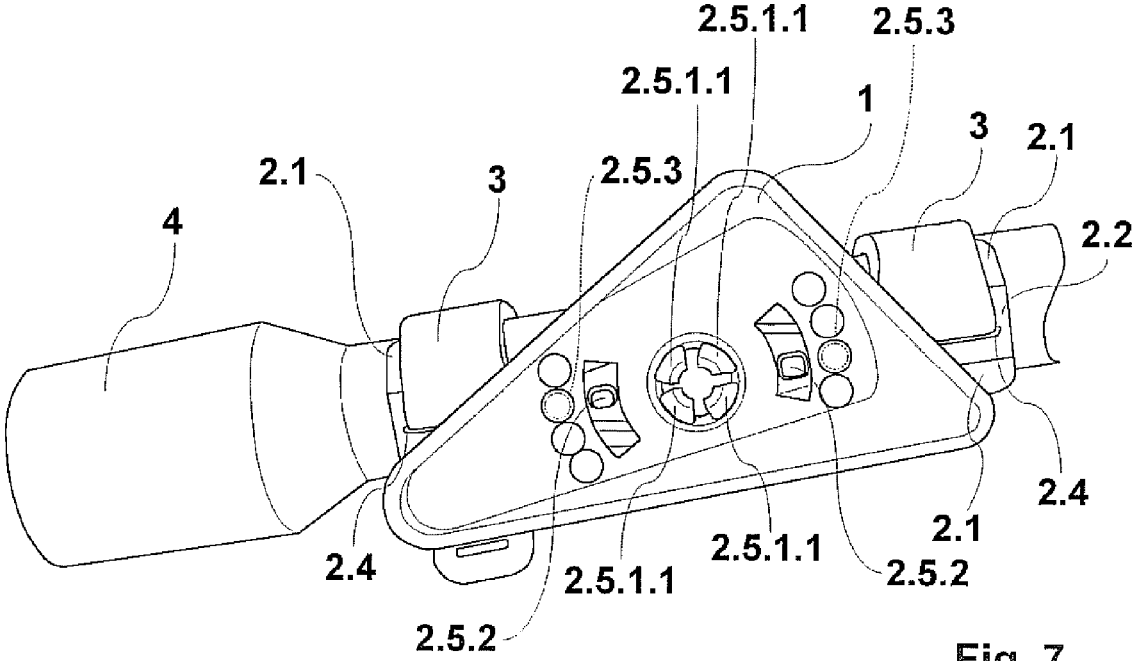
Figure 8:
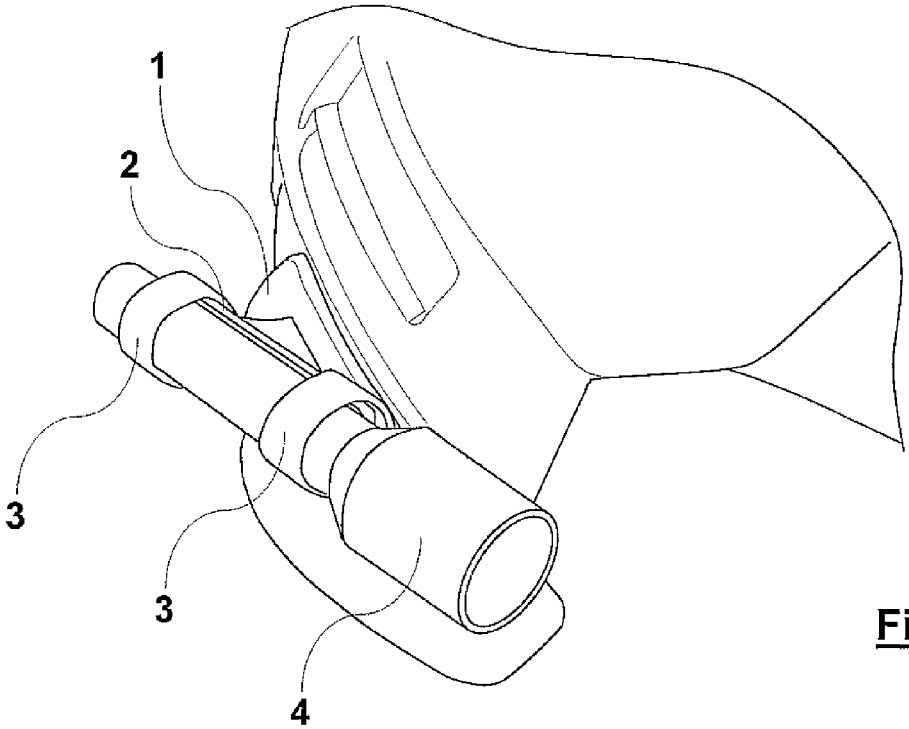
Figure 9:
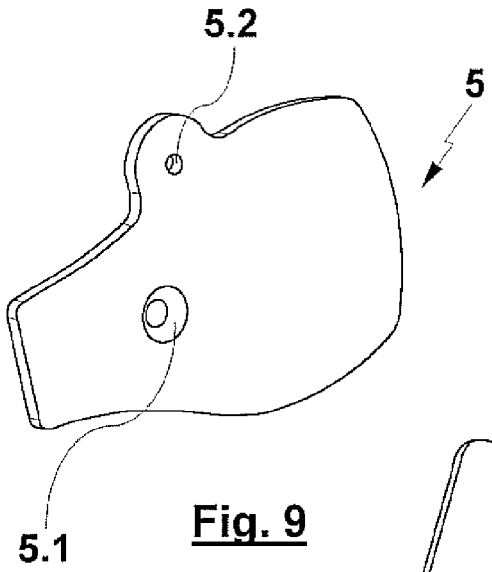
Figure 10:
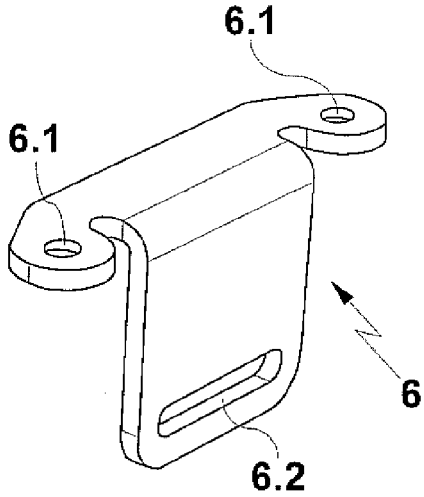
Figure 11:
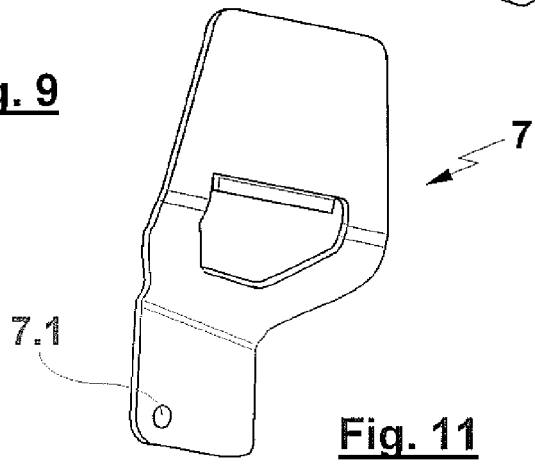
Figure 12:
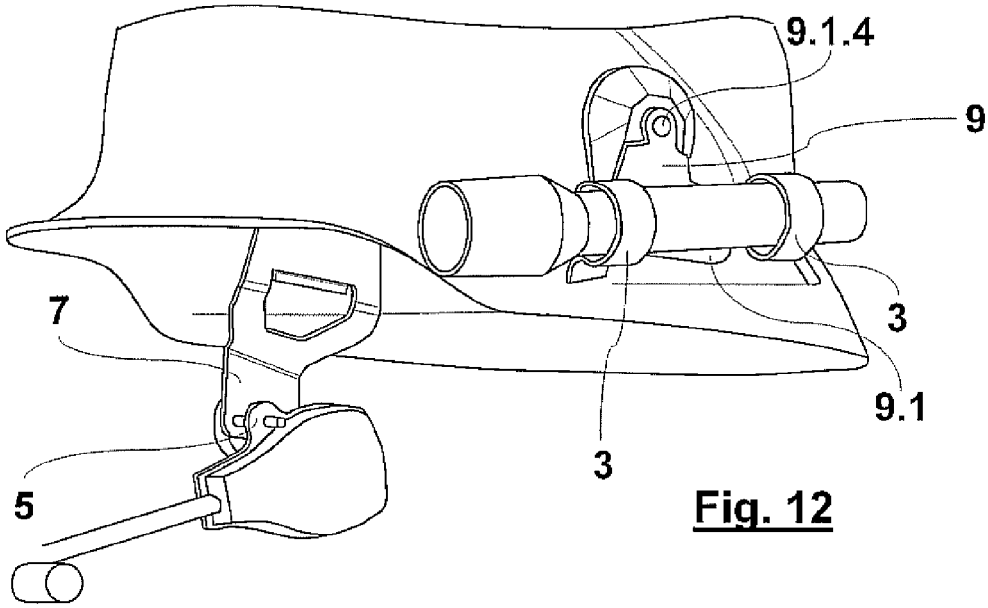
Figure 13:
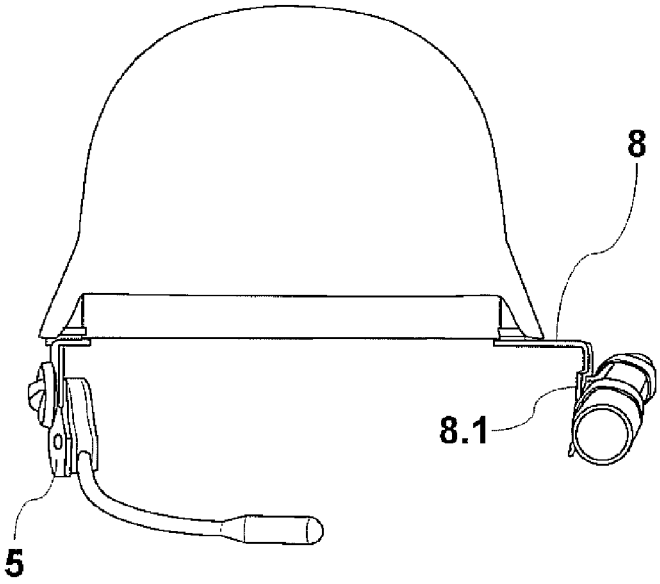
Figure 14:
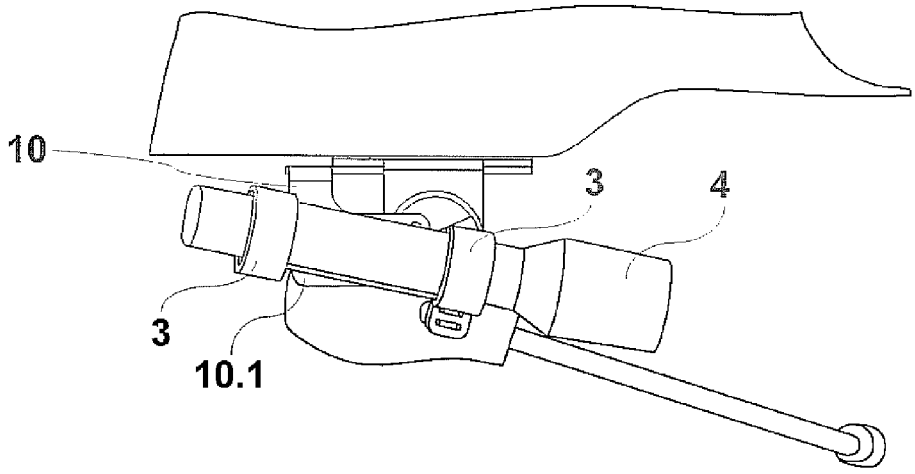
Figure 15:
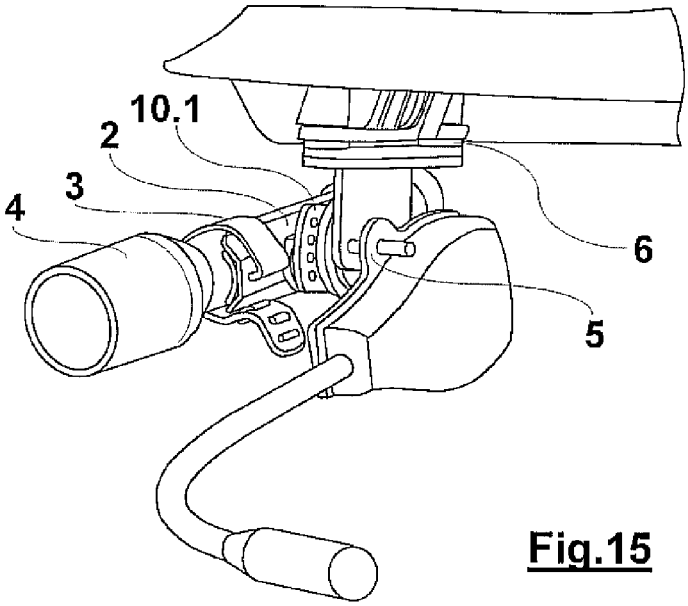

The adapter according to the invention generally comprises a base 1, a holder 2 and two securing parts 3. FIG. 1 shows a base 1, preferably made of plastic, for a protective helmet with molded snap-and-detent mechanism 1.1 with a central, circular hole 1.1.1, guide openings 1.1.2, round indentations 1.1.3 and, preferably, an opening 1.1.4 for fastening the base 1 onto a protective helmet. FIGS. 1.1, 1.2 and 1.3 show bases 8, 9 and 10, each featuring different fundamental shapes and made of metal or plastic for different protective helmets, and featuring a snap-and-detent mechanism 8.1, 9.1 and 10.1 that is the same as the snap-and-detent mechanism 1.1 already described for base 1. FIG. 2 illustrates holder 2 from rear view, made of plastic as an example. The basic body of holder 2 consists of a central longitudinal section 2.2 and two longitudinal sections 2.1 molded onto this such as to form a concave structure. A fastening lug 2.3 is molded onto each end of the outer edge of one of the longitudinal sections 2.1. The central longitudinal section 2.2 features a keyhole-shaped opening 2.4 in each end, and a snap-and-detent element 2.5 is radially molded onto each end of the outer surface of the central longitudinal section 2.2. The snap-and-detent element 2.5 consists of a central snap piece 2.5.1 with several relatively moveable guide pins 2.5.1.1, and serves to snap in and secure the holder 2 rotatably in the central circular hole 1.1.1 of a base 1, 1.1, 1.2, or 1.3. Two parabolic openings 2.5.4 are formed diametrically opposite each other in axial direction on both sides of the central snap piece 2.5.1, each forming a parabolic tab, the tips of which point away from each other on either side of the central snap piece 2.5.1. Molded onto each tab, also in axial direction, is a guide pin 2.5.2 and a spherical bump 2.5.3, where as the central snap piece 2.5.1 snaps into the central circular hole 1.1.1 of the base 1, the guide pins 2.5.2 penetrate into the guide openings 1.1.2 and the spherical bumps 2.5.3 each engage into one of the diametrically opposite round indentations 1.1.3. Being on parabolic tabs, the guide pins 2.5.2 and the spherical bumps 2.5.3 can move relative to the base 1, which is advantageous when the holder 2 bearing the equipment 4 is rotated to and detained at a desired angle parallel to the protective helmet. FIG. 3 shows a front view of the holder 2, which has been equipped with two securing parts 3 and is clicked onto a base 1. FIG. 4 and FIG. 5 show a securing part 3 from front view and top view respectively. The securing part 3 is a sturdy, yet flexible strap, preferably made of silicone. It has a concave holder element 3.1 on the face side, and a slot hole 3.2 and several elevations 3.3 molded into its surface on the opposite end. The holder element 3.1 ensures a stable position of the securing part 3 in the concave area of the holder 2, where the slot hole 3.2 serves to retain the securing part 3 on one of the fastening lugs 2.3 of the holder 2, and the elevations 3.3 serve as anti-slip grip elements for the convenience of the helmet wearer when tightening and closing the securing parts onto the holder 2. FIG. 6 shows a side view of the adapter according to the invention with the base 1, the holder 2 and the securing parts 3 closed on the holder 2, where the illustration is limited to the essential elements of the securing part 3 and the holder 2. FIG. 7 shows the rear view of a base 1 equipped with a holder 2, where a piece of equipment 4, for example a lamp, is fastened onto the holder 2 by two securing parts 3. This illustration shows, especially discernibly, the position of the parts of the snap-and-detent element 2.5 of the holder 2 inside the corresponding parts of the snap-and-detent mechanism 1.1 of the base 1. The adapter according to FIG. 8 is screwed onto a protective helmet, represented by a sectional drawing, by the base 1, preferably by the opening 1.1.4, and the holder 2 is equipped with a piece of equipment 4, for example a lamp, which is held onto the concave holder 2 by two securing parts 3, which are threaded into the keyhole-shaped openings 2.4 of the holder 2, by their concave holder element 3.1 molded onto the face side, where the securing parts 3 are wrapped around the holder 2 and the held piece of equipment 4, and are retained by their slot holes 3.2 on the fastening lugs 2.3 of the holder 2. The holder 2, thus complete, is snapped into the central, circular hole 1.1.1 in the base 1 by the snap-lugs 2.5.1.1 of its central snap-piece 2.5.1, whereby the guide pins 2.5.2 penetrate into the guide openings 1.1.2 and the spherical bumps 2.5.3 engage into the round indentations 1.1.3 of the base 1. The protective helmet wearer can adjust the angle of the lamp to what he considers optimal by rotating the holder 2 around the axis of the central snap-piece 2.5.1. The adjustment thus made is detained by the spherical bumps 2.5.3 engaging into the round indentations 1.1.3. FIG. 9 shows a mounting part 5 for fastening a headset, where opening 5.1 is for screwing the fittings onto the mounting part 5 and opening 5.2 is for screwing the mounting part 5 onto a connector 7 that is separately fastened onto one side of another protective helmet, according to FIG. 12. On the other side of the same protective helmet, the adapter according to the invention, bearing a lamp, is fastened onto the helmet via a base 9. FIG. 13 shows a protective helmet with a headset mounted on one side and the adaptor according to the invention, bearing a lamp, mounted via a base 8 on the other side. FIG. 14 shows the side view of an implied protective helmet, onto which an adapter bearing a lamp is mounted via a base 10. Finally, FIG. 10 shows another connector 6 via which the mounting part 5 with a headset screwed onto it can be mounted on one side of the helmet together with the adapter described above, bearing a lamp according to FIG. 15.

LIST OF REFERENCE NUMERALS USED

1 First base,
1.1 Snap-and-detent mechanism,
1.1.1 Central, circular hole,
1.1.2 Guide openings,
1.1.3 Round indentations,
1.1.4 Opening for screw connection,
2 Holder,
2.1 Outer longitudinal sections,
2.2 Central longitudinal section,
2.3 Fastening lugs,
2.4 Keyhole-shaped opening,
2.5 Snap-and-detent element,
2.5.1 Central snap-piece,
2.5.1.1 Snap-lugs,
2.5.2 Guide pins,
2.5.3 Spherical bumps,
2.5.4 Parabolic openings,
3 Securing parts,
3.1 Concave holder element,
3.2 Slot hole,
3.3 Elevations,
4 Equipment such as lamp or headset,
5 First connection and mounting part,
5.1 Screw hole,
5.2 Screw hole,
6 Second connecting and mounting part,
6.1 Screw hole,
6.2 Screw hole,
7 Third connecting and mounting part,
7.1 Screw hole,
8 Second base,
8.1 Snap-and-detent mechanism,
8.1.1 Central hole,
8.1.2 Guide openings,
8.1.3 Round indentations,
8.1.4 Screw holes,
9 Third base,
9.1 Snap-and-detent mechanism,
9.2 Central hole,
9.3 Guide openings,
9.4 Screw holes,
10 Fourth base,
10.1 Snap-and-detent mechanism,
10.2 Central hole,
10.3 Guide openings,
10.4 Screw holes.

One of ordinary skill in the art will also recognize that additional embodiments and configurations are also possible without departing from the teachings of the present invention or the scope of the claims which follow. This detailed description, and particularly the specific details of the exemplary embodiments disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. An adapter for mounting equipment (4) onto a protective helmet, comprising a base (1) fastened detachably onto the protective helmet, and a holder (2) with straps (3) that snap detachably into the base (1);

wherein the base (1) includes a snap-and-detent mechanism (1.1) that is fastened detachably onto the protective helmet;

wherein the holder (2) includes a snap-and-detent element (2.5) designed as a corresponding counter piece to the snap-and-detent mechanism (1.1) of the base (1); and wherein (i) at least two straps (3) are threaded into the holder (2), (ii) an insertable piece of equipment (4) can be fastened separately, flexibly and detachably by wrapping the at least two straps (3) around the equipment (4) and anchoring them onto the holder (2), and (iii) the snap-and-detent element (2.5) of the holder (2) snaps into the snap-and-detent mechanism (1.1) of the base (1) and, when in the base (1), is incrementally rotatable and detainable around an axis of the snap-and-detent element (2.5).

2. The adapter according to claim 1, wherein the snap-and-detent mechanism (1.1) of the base (1) includes a central, round hole (1.1.1) with two guide openings (1.1.2) arranged around the central, round hole (1.1.1) and multiple round indentations (1.1.3) arranged around the guide openings (1.1.2), wherein the guide openings (1.1.2) of the base (1) are shaped as arcs of a circle and are positioned diametrically opposite each other in an axial direction at a defined distance from the central, round hole (1.1.1), and wherein the round indentations (1.1.3) are arranged into arcs of a circle and positioned diametrically opposite each other in an axial direction at a defined distance from the guide openings (1.1.2), and at least one opening (1.1.4) is provided on the base (1) for detachably fastening the base (1) onto the protective helmet.

3. The adapter according to claim 2, wherein the holder (2) is essentially a rectangular part with two outer longitudinal sections (2.1) molded at a defined angle to a central longitudinal section (2.2) to form an overall concave shape, wherein a fastening lug (2.3) is molded onto each end of the outer edge of one longitudinal section (2.1), and a keyhole-shaped opening (2.4) is molded into each end of the central longitudinal section (2.2), at the centre of which the snap-and-detent element (2.5) is molded into the outer surface.

4. The adapter according to claim 1, wherein the straps (3) are equipped with a concave holder element (3.1) molded onto a face side, at least one slot hole (3.2), and multiple elevations (3.3).

5. The adapter according to claim 3, wherein the snap-and-detent element (2.5) of the holder (2) is molded radially to the central longitudinal section (2.2) between the keyhole-shaped openings (2.4) and includes a central snap piece (2.5.1) consisting of multiple circular, relatively moveable snap-lugs (2.5.1.1), with two relatively moveable guide pins (2.5.2) molded diametrically opposite each other in an axial direction and two spherical bumps (2.5.3) molded diametrically opposite each other in an axial direction, and with two parabolic openings (2.5.4) molded diametrically opposite each other in an axial direction.

6. The adapter according to claim 5, wherein, upon snapping the central snap piece (2.5.1) into the central, round hole (1.1.1) of the base (1), the guide pins (2.5.2) insert into the guide openings (1.1.2) where they remain movable, and the two spherical bumps (2.5.3) rest firmly in two respective, diametrically opposite round indentations (1.1.3) according to a desired adjustment angle of the equipment (4).

7. The adapter according to claim 1, wherein the straps (3) are substantially flat silicone straps.

* * * * *